US007134463B2

(12) United States Patent
Pallmann

(10) Patent No.: US 7,134,463 B2
(45) Date of Patent: Nov. 14, 2006

(54) APPARATUS FOR CHIPPING MATERIAL

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 208 days.

(21) Appl. No.: 10/686,676

(22) Filed: Oct. 17, 2003

(65) Prior Publication Data

US 2004/0250893 A1 Dec. 16, 2004

(30) Foreign Application Priority Data

Oct. 18, 2002 (DE) ..... 202 16 056 U

(51) Int. Cl.
*B27C 1/00* (2006.01)

(52) U.S. Cl. ..... 144/162.1; 407/53; 144/218

(58) Field of Classification Search ..... 144/162.1, 144/172, 176, 218, 235, 241, 363, 373; 408/226, 408/227, 230; 407/53; 241/101.3, 37
See application file for complete search history.

(56) References Cited

U.S. PATENT DOCUMENTS 3,678,883 A * 7/1972 Fischer ..... 116/208
6,250,295 B1 * 6/2001 Chanton et al. ..... 125/15

FOREIGN PATENT DOCUMENTS

DE 1965131 * 7/1971
DE 19859624 * 6/2000

* cited by examiner

*Primary Examiner*—Lowell A. Larson
*Assistant Examiner*—Shelley Self
(74) *Attorney, Agent, or Firm*—McGrath, Geissler, Olds & Richardson, PLLC

(57) ABSTRACT

An apparatus and a tool for chipping material are provided. The apparatus includes chipping tools arranged relative to one another inside a housing, whereby the chipping tools are constructed planiformly, and are arranged on carrier elements along a drum-shaped, disk-shaped, or ring-shaped chipping path. The chipping tools rotate relative to one another by rotating about an axis of rotation, and are each divided by a division line based on their thickness into a core area, which faces the carrier element, and a utilization area, which is positioned opposite of the chipping tools. The chipping tools have at least one bore, formed perpendicular to the division line, the bore extends across the utilization area and ends at the division line between the core area and the utilization area. In this way, an automatic indication of a critical state of attrition is accomplished, when from a static viewpoint damage to or destruction of the chipping tool as a result of mechanical stress during the operation of the apparatus can be expected.

24 Claims, 6 Drawing Sheets

6b

APPARATUS FOR CHIPPING MATERIAL

This non-provisional application claims priority under 35 U.S.C. § 119(a) on German Patent application No. 202 16 056.4, filed in Germany on Oct. 18, 2002, which is herein incorporated by reference.

BACKGROUND OF THE INVENTION

1. Field of the Invention

This invention relates to a chipping apparatus for materials and a disk-shaped chipping element.

2. Description of the Background Art

Conventional chipping devices in this class are known, for example, as disk mills, refiners, beater mills, or cone mills. In these chipping devices, the dumpable material is fed axially into the center of the chipping chamber, which is enclosed by the housing, and is then diverted into a radial direction, where chipping tools rotating around a central axis of rotation take hold of and chip the material.

The chipping tools are located inside the housing relative to one another at an axial or radial distance, and thus form a rotation-symmetrical milling gap where the chipping process takes place. The material is hurled against the profiled surface of the chipping tools, where it is broken up and crushed. For this purpose, the chipping tools are equipped with a specially designed surface, which, for the most part, is formed of riffle strips that are arranged radially.

During the operation of the conventional chipping apparatus, the riffle strips are exposed to heavy mechanical wear and tear, which, among other factors, is influenced by the type and purity of the material to be chipped. This results in natural wear of the chipping tools so that the worn-down chipping tools have to be replaced at regular time intervals. Customarily, the chipping tools are either replaced or recycled, by reconditioning the riffle strips through filing and sharpening. However, each time reconditioning takes place the thickness of the chipping tools decreases. Thus, reconditioning cannot be repeated interminably, rather, for static reasons, it must stop when the gradual weakening of the chipping tool cross-section has progressed to a point where the chipping tools are no longer able to withstand the mechanical stress during the chipping process.

This borderline divides a chipping tool, over its thickness, into a core area and a utilization area. The utilization area, on the surface of which the chipping process takes place, is characterized in that, through progressing wear and tear, it can be completely used up without risk to the function and fracture safety of the chipping tools. Thus, it is possible to completely use up the utilization area of the chipping tools when regrinding them.

The core area, on the other hand, is the part of the chipping tool, which is necessary for static reasons, so that the chipping tools do not break during the operation of a chipping apparatus. Therefore, the danger of using a chipping tool beyond its utilization area is that the chipping tool can no longer withstand the heavy mechanical stress and will be destroyed. The fragments resulting therefrom can lead to serious damage to the entire chipping apparatus.

A way to determine the state of attrition of the chipping tools, that is, to determine if the thickness of the chipping tool is sufficient from a static standpoint, is to check the remaining thickness of the chipping tool with the aid of gauges. This is done manually using an appropriate tool, whereby a measurement can only be taken at an edge of a chipping tool. This way of determining the state of attrition is relatively labor intensive, so that in the work place this procedure is often not done at all or not often enough. Moreover, the disadvantage of this procedure is that there is no automatic indicator of the state of attrition, that is, the operator of such a chipping apparatus has to check the state of attrition on his/her own initiative.

Another way to indicate the state of attrition of chipping tools is to put markings on the sides of a chipping tool that make up the thickness. These markings are in the division line between the utilization area and the core area. When the utilization area is reduced to where the marking is, the chipping tool must be replaced with a new one. The disadvantage of markings is that if put on the surface of the chipping tool, they can be erased by mechanical use and thus become invisible. When using stamps there is the danger that dirt deposits, which accumulate in the stamps over time, will make them hard to recognize.

Both procedures have the disadvantage that an examination of the state of the chipping tools can only take place at their edges. With uneven wear and tear, getting below the static minimum thickness in the middle of the surface remains undetected.

SUMMARY OF THE INVENTION

It is therefore an object of this invention to provide conventional chipping apparatuses with automatic, safe and reliable indicators of the state of attrition.

In a preferred embodiment of the invention, bores are formed in the core area of chipping tools of a chipping apparatus, which terminate in a division plane of the utilization area. As a result, with the progressive wear and tear of the chipping tools, a sudden formation of apertures in the surface of the chipping tools indicates that the utilization area has been reached.

A first advantage of the invention is the automatic indication of an attrition border. An operator of a device of this invention no longer has to take the initiative to determine the state of attrition of the chipping tools. Rather, the need to change out the tools is signaled to the operator by the appearance of apertures in the surface of the chipping tools. The apertures, which appear in the otherwise evenly structured surface of the chipping tools when the attrition border is reached, are easily visible and thus hard to miss so that very good recognition is guaranteed, which improves the operational safety for the operator.

A further advantage of the invention is the option to place an arbitrary number of bores at arbitrary locations. This makes it possible to monitor the state of attrition not only at the edges of the chipping tools, but also, for example, in the middle of the surface. This also allows an indication of the state of attrition when uneven wear and tear across the surface of the chipping tool occurs.

In a further advantageous embodiment of this invention, the bores, at their lowest point, taper to a point, that is, the bores terminate, pointed, in the division plane between the core area and the utilization area. When attrition takes places beyond the utilization area, inevitably an enlargement of the apertures takes place. In this way, the urgency of a tool change can be determined from the size of the apertures.

Preferred are bores that have a constant cross-section, whereby the depth can be varied. Such a bore can be formed in a simple way with a bore having a cone-shaped borehole.

In a further advantageous embodiment of the invention, the bores are made with drills having an internal screw thread. This allows the fastening of the chipping tools with screws, which, extending from the carrier elements, engage with the bores made by drills with internal screw threads.

This gives the bores a double function, namely, the fastening of the chipping tools and the indication of the state of attrition of the chipping tools.

In a particularly beneficial embodiment of the invention is an arrangement, whereby the bores are spaced from the outer edge of the chipping tools in intervals of 5% of the total diameter of the chipping tools. In this way, at least the state of attrition of those areas of the chipping tools, which are exposed to heavier wear and tear, is being monitored. In order to maintain minimum control over the overall state of attrition of the chipping tools, at least three equally spaced bores are provided, that is, three bores are provided at an angular distance of 120° to the axis of rotation. By increasing the number of bores, the angular distance is decreased proportionally.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIGS. 6*a* and 6*b* are top views of a section of a chipping tool according to the invention.

DETAILED DESCRIPTION OF THE PREFERRED EMBODIMENTS

Figure 1:
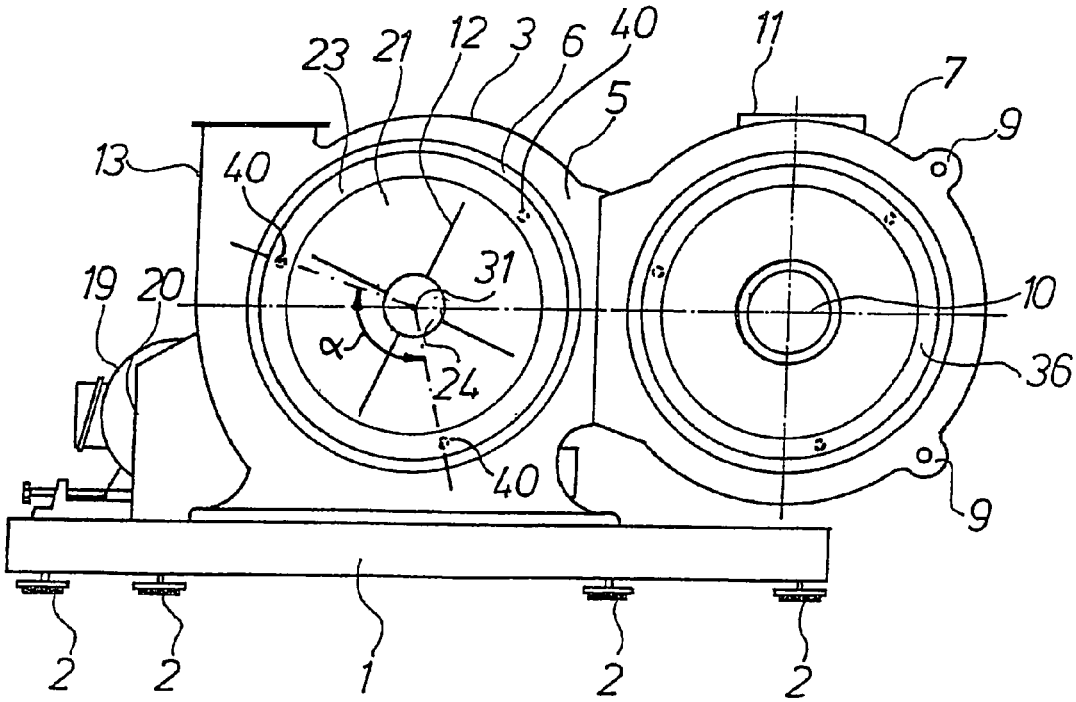
FIG. 1 is a front view of an apparatus of this invention, with the housing door open.
Figure 2:
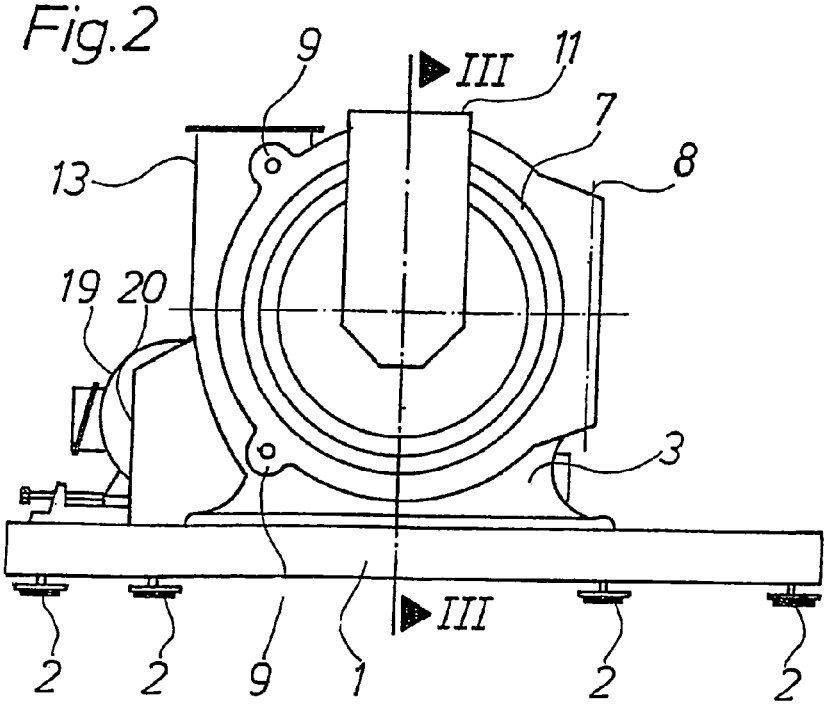
FIG. 2 is a front view of the apparatus illustrated in FIG. 1, with the housing door closed.
Figure 3:
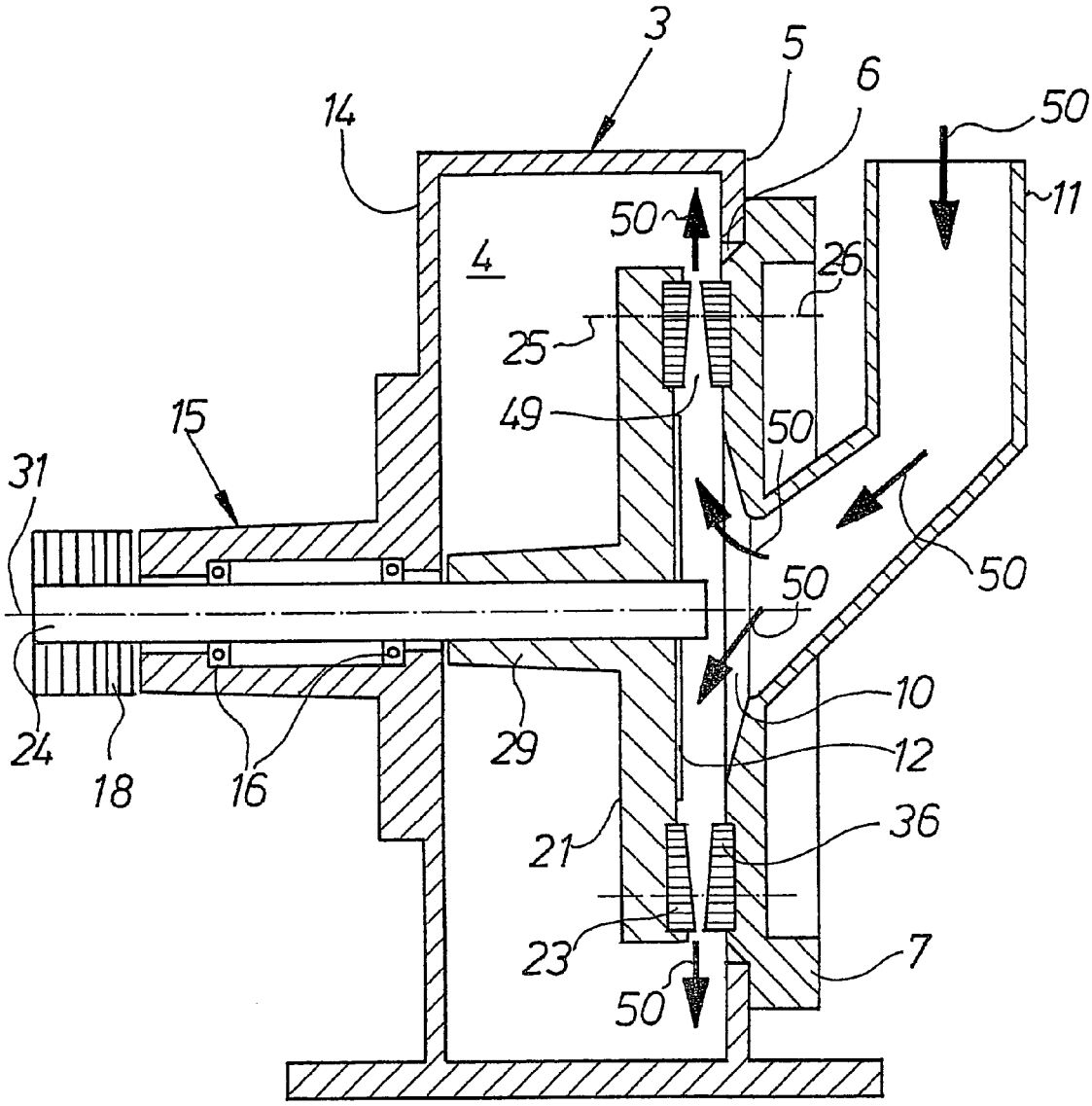
FIG. 3 is a vertical cross-section of the apparatus illustrated in FIG. 2 along the line III—III.

In FIGS. 1, 2, and 3, the essential elements of an apparatus of this invention are illustrated. In FIGS. 1 and 2, which are front views showing a housing door 7 opened and closed, respectively, and an apparatus substructure 1 having its feet 2 on a solid base. The upper part of the apparatus substructure 1 forms a platform, onto which a chipping device according to the present invention is mounted.

The chipping device includes a drum-shaped housing 3 that encloses a chipping chamber 4. On its front wall 5, the housing 3 has a central circular opening 6, which can be closed by using a housing door 7 that pivots about a vertical axis 8 and can be locked with locks 9.

The housing door 7 is also equipped with a central input opening 10, to which a fall shaft 11 is attached, which extends vertically from the outside and, at a slant angle in the bottom area, connects to the input opening 10. The input opening 10 expands conically across the thickness of housing door 7 towards the chipping chamber 4. Material is transferred out using a material discharge 13, which, as shown in the illustration, tangentially extends out of the housing 3, and which can be attached, for example, to a suction device.

A rear wall 14 of the housing 3 is reinforced to create a horizontal bearing area 15 with bearing groups 16. Through the rear wall 14 of the housing 3 and rotably positioned in the bearing groups 16, extends a drive shaft 24, to the outer end of which a multiple-groove pulley 18 is attached. The multiple-groove pulley 18 is connected to the drive motor 19 (shown only in FIGS. 1 and 2) with belts. The belts are located inside a protective covering 20.

At the opposite end of the drive shaft 24, which is located in the chipping chamber 4, a carrier disk 21 with its hub 29 is positioned, which, with the drive shaft 24, can be rotated about an axis of rotation 31. The surface of the carrier disk 21, which faces the input opening 10, features radially extending distributor ribs 12. On the same side of the disk 21, the first chipping tools 23 are arranged in a circular manner about the circumference. Across from the first chipping tools 23, second chipping tools 36 are positioned at an axial distance, whereby the first and second chipping tools 23, 36 form a radial chipping gap 49 therebetween. The second chipping tools 36 are mounted to the inside of the housing door 7.

Figure 4:
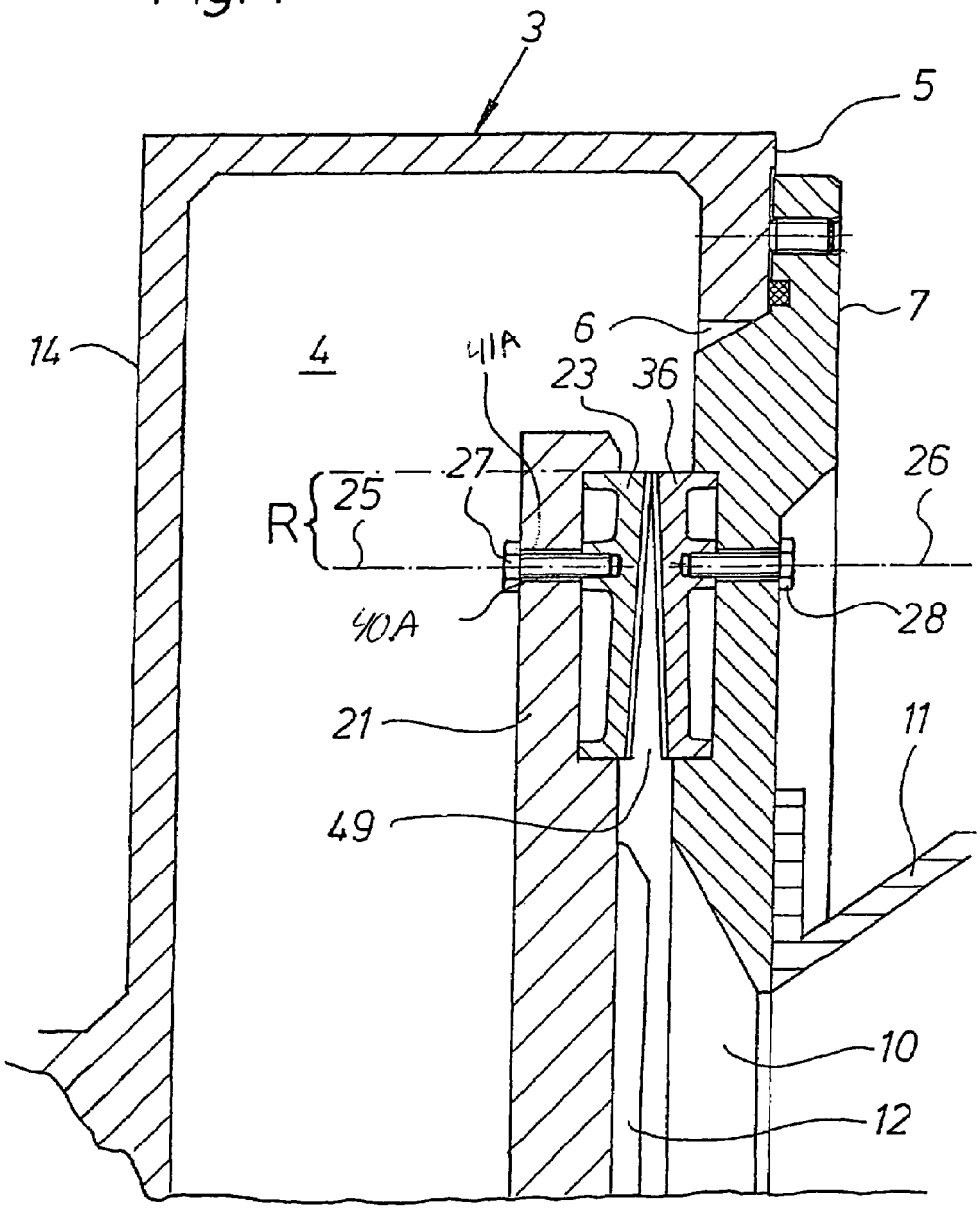
FIG. 4 is a sectional view of FIG. 3 on a larger scale.

The mounting of the first and second chipping tools 23, 36 is illustrated in detail in FIG. 4. In the area of the chipping path, extending in a ring-wheel shape around the axis of rotation 31, the carrier elements, that is, the carrier disk 21 and housing door 7, have ring-shaped indentations formed therein, which are custom-fitted for the chipping tools. Thus, the position of the first and second chipping tools 23, 36 in the plane vertically to their axis of rotation 31 is safeguarded. In addition, the first and second chipping tools 23, 36 are retained in the axes 25 and 26 by fastening screws 27 and 28, respectively. The fastening screw 27 extends through the carrier disk 21 and connects with interior screw threads 41*a* of a bore 40*a* in the chipping tool 23. In a similar manner, the chipping tool 36 is fastened by the fastening screw 28, which extends through housing door 7.

Both of the first and second chipping tools 23, 36 can be formed as a one-piece tool ring, which is fastened with several fastening screws to the carrier disk 21 and the housing door 7, respectively. As an alternative, multiple chipping tools 23 and 36, which in each case extend across a section of the milling path, can be arrayed in a ring-shaped formation. In both instances, fastening is done by using fastening screws 27 and 28 as described with reference to FIG. 4. Also, FIG. 4 illustrates that a radial distance R of the recess to an outer edge of the chipping tools is approximately 5% of a diameter of the chipping tools.

Figure 5:
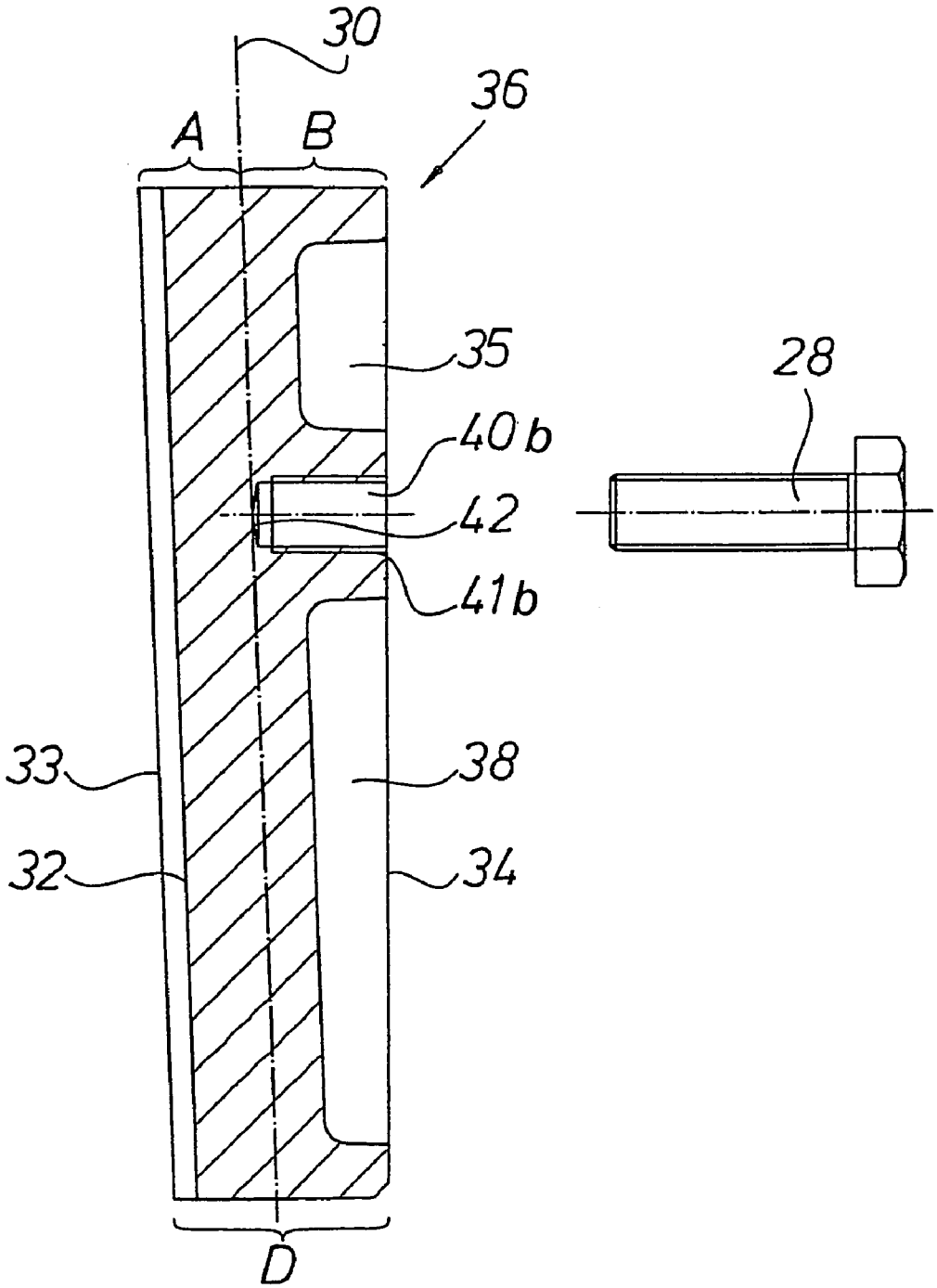
FIG. 5 is a cross-sectional view of a chipping tool of this invention.

The more detailed installation of first and second chipping tools 23, 36 is illustrated in FIG. 5, using chipping tool 36 as an example. The chipping tool 36 is massive and plate shaped. In a cross-sectional view, the chipping tool has a slightly conical shape, whereby the outer edge extending in a radial direction has, as compared to the inner edge, a greater width. With two chipping tools facing one another, this results in a tapering of the chipping gap in a radial direction.

The active front side 32 includes sharp grooved strips 33 for chipping the material. The rear side 34 of the chipping tool 36 features recesses 35 and 38, which result in a reduction of material and weight. The areas of the rear side 34, which are not recessed, are planely ground and form the area where the chipping tool 36 rests on the carrier element, which in this case is the housing door 7.

Spanning its entire thickness D, the chipping tool 36 is divided into a utilization area A and a core area B. The division line shown in FIG. 5 with reference numeral 30, which extends in a parallel direction to the front side 32, is thus the division line between the two utilization area A and core area B.

Approximately in the upper third and perpendicular to a rear side 34 of the chipping tool 36, a drilled bore 40*b* is provided, the inner area of which has a screw thread 41*b*. The bottom 42 of the bore 40*b* is evenly cone shaped. The depth of the bore 40*b* is formed such that the tip of the cone-shaped bottom 42 of the bore terminates at the division line 30.

During the operation of the chipping apparatus, the material is dumped into the fall shaft 11, from where it moves centrally through the input opening 10 into the chipping chamber 4, which is enclosed by housing 3. There, it first encounters the central area of the rotating carrier disk 21, is conveyed by the distributor ribs 12 and moved in a circular fashion. Because of centrifugal force, the material is directed in a radial direction to the first and second chipping tools 23, 36. While passing the milling gap 49, which is formed between the first and second chipping tools 23, 36, the material is hurled several times at high speed against the grooved strips 33 on the front side 32 and is broken up and crushed in the process. Upon passing the milling gap 49 in a radial direction, the chipping process is finished and the material is conveyed via the tangential material discharge 13, to other processing stations (not shown). The arrows 50 in FIG. 3 illustrate the flow of the material by the chipping apparatus according to this invention.

The parts primarily used during the chipping process are the first and second chipping tools 23, 36, which is noticeable because of the gradual attrition of the front side 32. In the process, the grooved strips wear down and become dull. This results in insufficient processing of the material in regard to output and quality. For this reason, the front side 32 of the first or second chipping tools 23, 36 is reconditioned at regular time intervals in order to restore the grooved strips 33 to their original shape. However, as a consequence of each reconditioning process, the thickness of the utilization area A is reduced so that the thickness D of the first or second chipping tools 23, 36 decreases each time.

Repeated grinding of the first or second chipping tools 23, 36 can decrease the thickness D to such a degree that the front side 32 coincides with the division line 30. At this point, the entire utilization area A of the first or second chipping tools 23, 36 is used up, with only the core area B remaining.

Figure 6A:
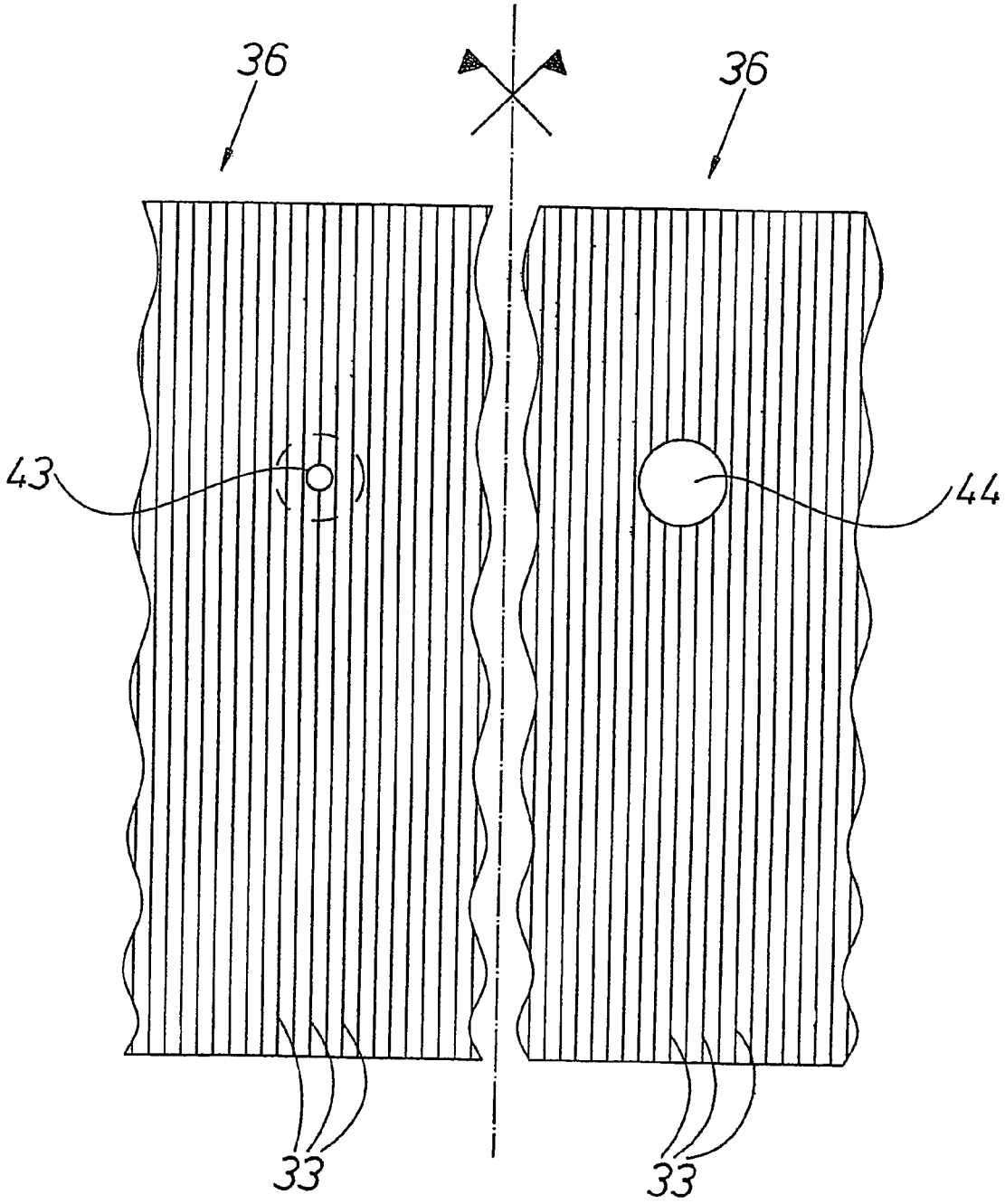

In order to prevent further wear of the first or second chipping tools 23, 36 and the risks associated therewith, it must be signaled to the operator of a chipping apparatus that a critical state of attrition has been reached. For this purpose, the bore 40*a* or 40*b*, which extends, at its lowest point, e.g., maximum depth, all the way to the division line 30. Therewith, because of the reduction of the thickness D of the first or second chipping tools 23, 36 to the division line 30, the bore 40*a*, 40*b* on the front side 32 of the first or second chipping tools 23, 36 becomes visible, namely as an aperture. The critical state of attrition is illustrated in FIG. 6*a*, whereby a circular aperture 43 having a small diameter is visible.

Because of the evenly cone-shaped design of the bottom 42 of the bore 40*a*, 40*b* the diameter of the aperture, which is visible on the front side 32 becomes increasingly bigger with continuous wear and tear. This state is illustrated with aperture 44 in FIG. 6*b*. In this way, the invention not only succeeds in indicating the expiration of the operational use of the first or second chipping tools 23, 36, but also the degree of attrition after the attrition border was crossed, e.g., reached, and thus, the urgency with which a tool change is needed.

The invention as described above is based on the assumption that the precise position of the division line 30 between utilization area A and core area B is, from a static viewpoint, automatic. Naturally, it is within the scope of the invention to determine a different distribution of the utilization area A and the core area B and thus the precise position of the division line 30 for other considerations. With the present invention, however, even with a different distribution, the end of the utilization area A is indicated by bore 40*a*, 40*b* in the core area B to the division line 30.

Figure 7:
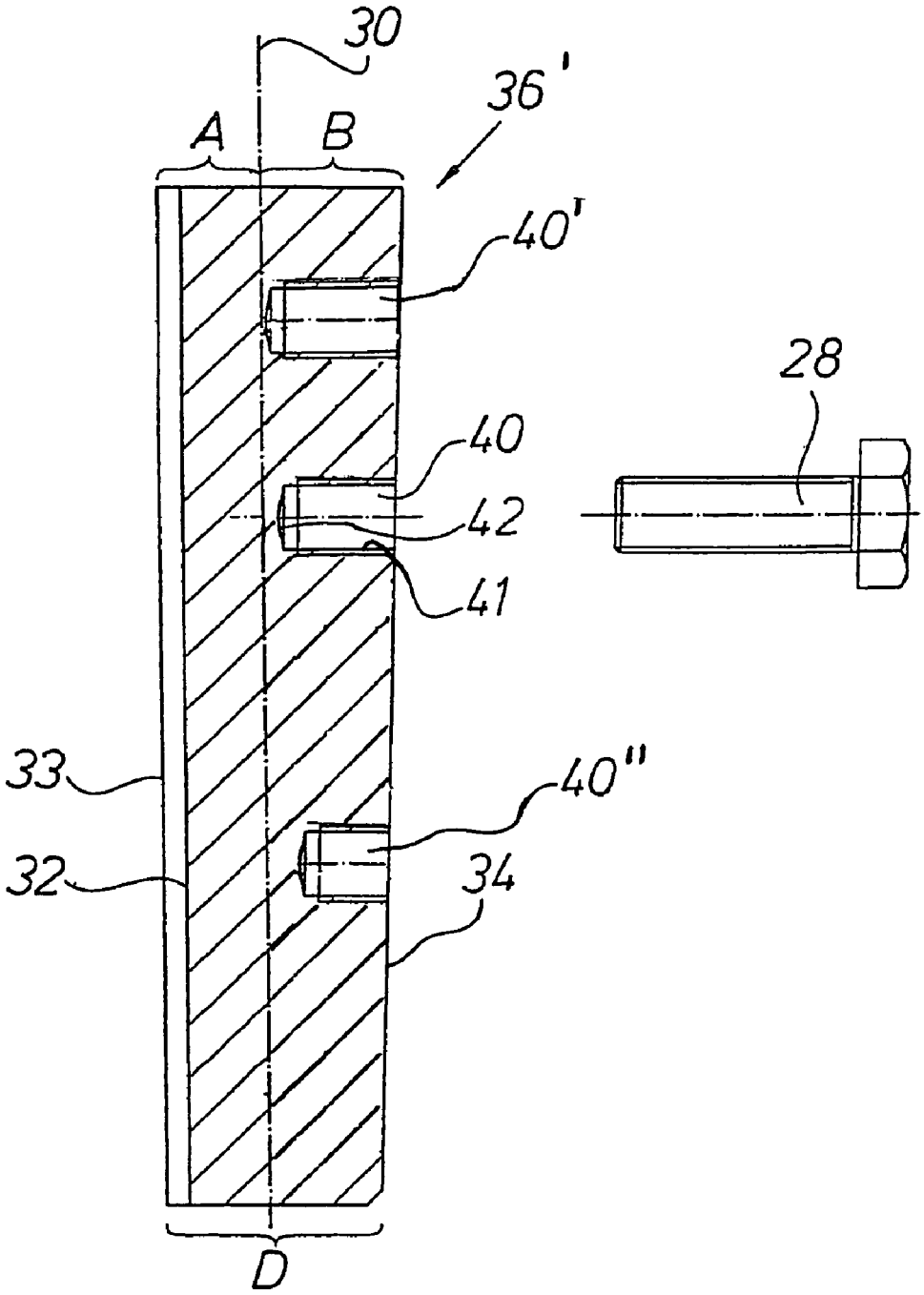
FIG. 7 illustrates a chipping tool according to an embodiment of the present invention.

Furthermore, in order to maintain minimum control over the overall state of attrition of the chipping tools, at least three equally spaced bores are provided at, for example, an angular distance a (see FIG. 1) of 120° between one another in a plane that is substantially perpendicular to the axis of rotation. In addition, the bores 40*a*, 40*b*, can each have a depth that is a variable, as can be seen in FIG. 7.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A chipping apparatus for chipping material comprising:

first and second chipping tools arranged in a housing, at least one of the first or second chipping tools being planiform and at least one of the first or second chipping tool being arranged on a carrier element along a drum-shaped, disk-shaped, or ring-shaped chipping path moving relative to one another, wherein at least one of the first or second chipping tools rotate about an axis of rotation, wherein a thickness of the first or second chipping tool is divided into a core area, which faces the carrier element, and a utilization area positioned adjacent the core area, and wherein the first or second chipping tools have at least one recess formed substantially perpendicular to a division line, which extends across the core area and ends in a division line provided between the core area and the utilization area.

2. The chipping apparatus according to claim 1, wherein the recess is pointed at its lowest point.

3. The chipping apparatus according to claim 1, wherein the recess has parallel boundary walls and a bottom of the recess is concave or cone shaped.

4. The chipping apparatus according to claim 1, wherein the recess is a bore hole.

5. The chipping apparatus according to claim 1, wherein the recess has an internal screw thread and wherein the first and/or second chipping tools are fastened to the carrier elements by screws, whereby the screws extend from the carrier element to the recess.

6. The chipping apparatus according to claim 1, wherein a radial distance of the recess to an outer edge of the chipping tools is approximately 5% of a diameter of the chipping tools.

7. The chipping apparatus according to claim 1, wherein a maximal angular distance between the recess and another recess in a plane that is substantially perpendicular to the axis of rotation is 120°.

8. The chipping apparatus according to claim 1, wherein the carrier elements of the first or second chipping tools are formed by the housing.

9. The chipping apparatus according to claim 1, wherein the carrier elements of the first or second chipping tools are formed by a disk, a ring wheel, or a drum.

10. A disk-shaped chipping tool for use in a chipping apparatus, the chipping tool being divided by a division line into a utilization area and a core area, wherein the core area has at least one recess extending substantially perpendicular to the division line of the chipping tool, the recess extending towards the utilization area and ends at the division line between the core area and the utilization area.

11. The disk-shaped chipping tool according to claim 10, wherein the recess is pointed at its lowest point.

12. The disk-shaped chipping tool according to claim 10, wherein the recess has parallel boundary walls and the bottom of the recess is preferably concave or cone shaped.

13. The disk-shaped chipping tool according to claim 10, wherein the recess is a bore hole.

14. The disk-shaped chipping tool according to claim 13, wherein the recess has an internal screw thread to accommodate a fastening screw.

15. A chipping apparatus comprising:

a carrier element arranged within a housing of the chipping apparatus; and at least one chipping tool for chipping material being fastened onto the carrier element, wherein the at least one chipping tool is divided by a border into a utilization area and a core area along a length of the at least one chipping tool, wherein the utilization area includes riffles formed therein for chipping the material, and wherein the core area has at least one bore formed therein, the at least one bore extends through the core area and terminates at the utilization area, such that a visible indication of the bore from the utilization area determines a state of attrition of the utilization area.

16. The chipping apparatus according to claim 15, wherein the bore is cone shaped in an area approximate to the border.

17. The chipping apparatus according to claim 15, wherein the bore facilitates the fastening of the at least one chipping tool onto the carrier element.

18. The chipping apparatus according to claim 17, wherein the bore includes threads for receiving a screw for fastening the at least one chipping tool onto the carrier element.

19. The chipping apparatus according to claim 15, wherein the bore is displaced substantially perpendicular to the border.

20. The chipping apparatus according to claim 15, wherein the bore extends through the core area substantially perpendicular with respect to a face of the core area.

21. The chipping apparatus according to claim 1, wherein the first or second chipping tools have a plurality of recesses, the plurality of recesses each having a depth that is variable.

22. The chipping apparatus according to claim 1, wherein a depth of the at least one recess varies based on an attrition state.

23. The chipping tool according to claim 10, wherein the chipping tool has a plurality of recesses, the plurality of recesses each having a depth that is variable.

24. The chipping tool according to claim 10, wherein a depth of the at least one recess varies based on an attrition state.

* * * * *